US006133679A

United States Patent [19]

Terui et al.

[11] Patent Number: 6,133,679

[45] Date of Patent: Oct. 17, 2000

[54] THERMAL FIELD EMISSION CATHODE

[75] Inventors: Yoshinori Terui; Katsuyoshi Tsunoda, both of Shibukawa, Japan

[73] Assignee: Denki Kagaku Kogyo Kabushiki Kaisha, Tokyo, Japan

[21] Appl. No.: 09/169,980

[22] Filed: Oct. 13, 1998

[51] Int. Cl.[7] ..... H01J 1/14

[52] U.S. Cl. ..... 313/346 R; 313/336; 313/346 DL

[58] Field of Search ..... 313/336, 346 R, 313/346 DL

[56] References Cited

U.S. PATENT DOCUMENTS 5,449,968 9/1995 Trrui et al. ..... 313/336

*Primary Examiner*—Vip Patel

*Attorney, Agent, or Firm*—Oblon, Spivak, McClelland, Maier & Neustadt, P.C.

[57] ABSTRACT

A thermal field emission cathode comprising a tungsten single crystal having an axis direction of <100> and a coating layer of zirconium and oxygen formed thereon, wherein a source for supplying zirconium and oxygen contains an element capable of forming cubic or tetragonal zirconium oxide at an operation temperature of the thermal field emission cathode.

14 Claims, 1 Drawing Sheet

THERMAL FIELD EMISSION CATHODE

BACKGROUND OF THE INVENTION

1. Field of the Invention

The present invention relates to a thermal field emission cathode which is used as an electron beam source for e.g. an electron microscope, an electron beam lithography system, an electron IC beam tester or a wafer inspection equipment.

2. Discussion of Background

In recent years, in order to obtain an electron beam with higher brightness, a thermal field emission cathode employing a needle electrode of tungsten single crystal has been utilized. This thermal field emission cathode is one having a coating layer of zirconium and oxygen (hereinafter referred to as the ZrO coating layer) formed on a tungsten single crystal chip (hereinafter referred to as the W-chip) having an axis direction of <100>, so that the work function of (100) face of the tungsten single crystal is reduced to about 2.8 eV by the ZrO coating layer, whereby only the very fine crystal facet corresponding to the (100) face formed at the forward end of the W-chip, constitutes an electron emitting region, and whereby an electron beam with higher brightness than conventional thermoionic cathodes, can be obtained, and yet, it has a characteristic of long service life. Further, it has more stable electroemitting characteristics than a cold field emission cathode has, so that it can be operated under a relaxed vacuum degree and is easy to use.

As shown in FIG. 1, the thermal field emission cathode comprises the W-chip 1 for emitting an electron beam, which is fixed by e.g. welding to a predetermined position of a tungsten wire 3 supported by metal supports 5 fixed to an insulating glass 4, and a suppressor electrode 2 for forming an electric field to suppress thermoionic emission from e.g. the above mentioned tungsten wire 3.

As shown in FIG. 2, a source for supplying zirconium and oxide, i.e. a reservoir 6, is provided at a portion of the W-chip 1. Although not shown in the Figure, the surface of the W-chip 1 is covered by a ZrO coating layer. The W-chip 1 is heated by electric current through the tungsten wire 3 and is used at a temperature of about 1800 K, whereby the ZrO coating layer on the surface of the W-chip 1 evaporates. However, zirconium and oxygen will diffuse from the reservoir 6 and will be continuously supplied to the surface of the W-chip 1, and consequently, the ZrO coating layer will be maintained.

A method comprising the following three steps, is known as a conventional method for accomplishing a low work function by forming a ZrO coating layer on the W-chip.

First step: A solvent such as an organic solvent, is added to a powder of zirconium hydride as a zirconium-containing material, to obtain a slurry, which is then attached to the W-chip having an axis direction of <100>, to form a lump of zirconium hydride.

Second step: The W-chip is heated under high vacuum to decompose zirconium hydride into zirconium and hydrogen, thereby to diffuse zirconium into the W-chip surface.

Third step: The W-chip is heated in an oxygen atmosphere of about $10^{-6}$ Torr to form a ZrO coating layer on the W-chip surface. (see U.S. Pat. No. 4,324,999.)

Such a conventional thermal field emission cathode has had a problem that the frequent temperature rise and drop under a practical operation causes cracks in the reservoir, and in an extreme case, the reservoir falls off, whereby the service life of the thermal field emission cathode tends to be substantially short. Therefore, in practical use of such a thermal field emission cathode, it has been common to set a restriction in its use to avoid frequent temperature rise and drop and to maintain the operation temperature constant without raising or lowering the temperature as far as possible once the operation temperature has been set.

However, it is unavoidable to repeat raising and lowering the temperature of the thermal field emission cathode during the production and adjustment of an electron beam equipment. Likewise, it is unavoidable to raise and lower the temperature many times for the maintenance of the equipment also in the practical operation. Further, due to an unexpected trouble, the temperature may instantaneously drop. Accordingly, it has been desired to develop a thermal field emission cathode free from falling off of the reservoir.

SUMMARY OF THE INVENTION

The present invention has been made in view of such problems. It is an object of the present invention to provide a thermal field emission cathode which is durable against repeated temperature rise and drop so that the reservoir scarcely falls off and which accordingly has a long service life and high reliability and yet is excellent in the operation.

Namely, the present invention provides a thermal field emission cathode comprising a tungsten single crystal having an axis direction of <100> and a coating layer of zirconium and oxygen formed thereon, wherein a source for supplying zirconium and oxygen contains an element capable of forming cubic or tetragonal zirconium oxide at an operation temperature of the thermal field emission cathode.

The present invention provides the above thermal field emission cathode wherein said element is at least one element selected from Group 2A and Group 3A, preferably the above thermal field emission cathode wherein said element is at least one of calcium and yttrium, more preferably the above thermal field emission cathode wherein said element is calcium.

As a practical embodiment, the present invention provides the above thermal field emission cathode wherein the source for supplying zirconium and oxygen, is zirconium oxide containing calcium in an amount of from 4 to 20 mol % as calculated as its oxide, preferably the above thermal field emission cathode wherein the source for supplying zirconium and oxide, is zirconium oxide containing calcium in an amount of from 15 to 20 mol % as calculated as its oxide.

Further, the present invention provides a thermal field emission cathode comprising a tungsten single crystal having an axis direction of <100> and a coating layer of zirconium and oxygen formed thereon, wherein a source for supplying zirconium and oxygen contains at least one of cubic zirconium oxide and tetragonal zirconium oxide, and at least one element selected from Group 2A and Group 3A, preferably such a thermal field emission cathode wherein the source for supplying zirconium and oxygen is cubic zirconium oxide, more preferably such a thermal field emission cathode wherein the cubic zirconium oxide contains at least one of calcium and yttrium.

As a practical embodiment, the present invention provides the above thermal field emission cathode wherein the cubic zirconium oxide is zirconium oxide containing calcium in an amount of from 4 to 20 mol % as calculated as its oxide, preferably the above thermal field emission cathode, wherein the cubic zirconium oxide is zirconium oxide containing calcium in an amount of from 15 to 20 mol % as calculated as its oxide.

Still further, the present invention provides a method for producing a thermal field emission cathode comprising a tungsten single crystal having an axis direction of <100> and a coating layer of zirconium and oxygen formed thereon, which comprises coating a slurry comprising a solvent and a powder containing zirconium and at least one element selected from Group 2A and Group 3A, followed by heating in an oxidizing atmosphere to form a source for supplying zirconium and oxygen on said tungsten single crystal, preferably such a method for producing a thermal field emission cathode wherein said powder contains zirconium oxide and zirconium hydride, or such a method for producing a thermal field emission cathode, wherein said powder contains zirconium oxide prepared by heating zirconium oxide containing from 4 to 20 mol % of calcium oxide at a temperature of from 1400 to 1800 K.

DETAILED DESCRIPTION OF THE PREFERRED EMBODIMENTS

Figure 1:
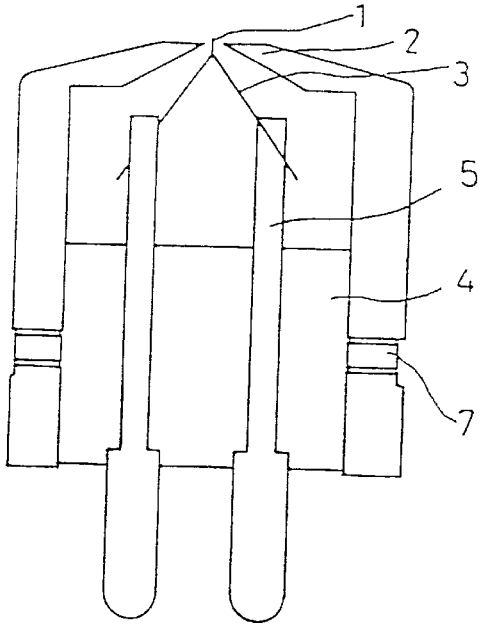
FIG. 1 is a cross sectional view of a thermal field emission cathode.
Figure 2:
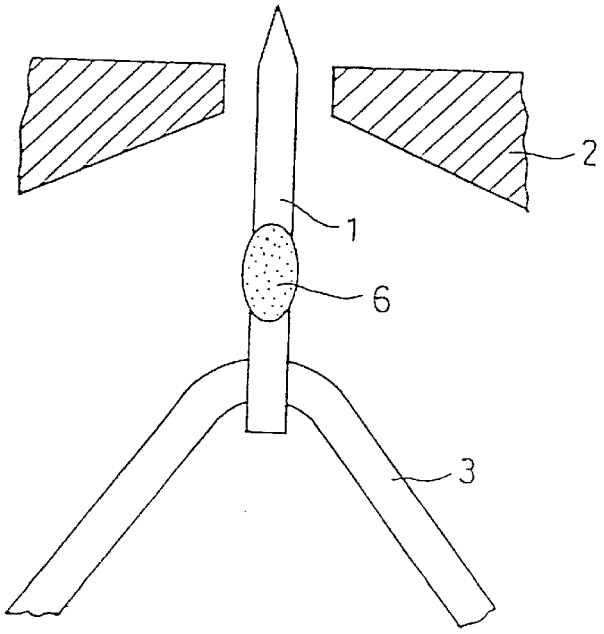
FIG. 2 is an enlarged view of a portion of FIG. 1 illustrating a W-chip and a tungsten wire.

The present inventors have considered that zirconium oxide constituting the reservoir undergoes a phase transition between a monoclinic system and a tetragonal system along with the temperature rise and drop, and falling off of the reservoir which used to occur with a conventional thermal field emission cathode, is attributable to the volume change of zirconium oxide due to the phase transition. On this basis, they have conducted an experimental study to solve the problem and have finally accomplished the present invention.

Namely, zirconium oxide normally belongs to a monoclinic system at room temperature, but as the temperature rises, it undergoes a phase transition to a tetragonal system at 1200° C. and to a cubic system in the vicinity of 2400° C., and as the temperature lowers, it undergoes a phase transition from the cubic system to the monoclinic system via the tetragonal system. The phase transition between the monoclinic system and the tetragonal system accompanies a volume change of as large as about 4.6%. Accordingly, if the reservoir made of zirconium oxide is subjected to the temperature rise and drop repeatedly, the reservoir is likely to break or likely to peel from the boundary with the needle electrode.

The thermal field emission cathode of the present invention is characterized in that the crystal phase of zirconium oxide constituting the reservoir, is a thermally stable cubic system or a thermally metastable tetragonal system within the operation temperature range of the thermal field emission cathode. For this purpose, an element capable of forming such a cubic or tetragonal zirconium oxide within the temperature range in which the thermal field emission cathode is used. Otherwise, the purpose of the present invention can be accomplished also by incorporating such a cubic or tetragonal zirconium oxide preliminarily to the reservoir prior to the actual use. Here, "thermally stable" or "thermally metastable" means such a nature that zirconium oxide which once became a cubic system or tetragonal system crystal, remains to be the cubic system or tetragonal system crystal even when cooled to room temperature.

In the present invention, at least one element selected from Group 2A and Group 3A is incorporated in the reservoir, whereby said element can readily be solid-soluble in zirconium oxide during the heating process under a practical operation, and as a result, it is possible to form a stable phase of cubic zirconium oxide or a metastable phase of tetragonal zirconium oxide against repeated temperature rise and drop and thereby to prevent falling off of the reservoir.

Examples of "at least one element selected from Group 2A and Group 3A" include magnesium, yttrium, calcium and cerium. Among them, calcium and yttrium are preferred, since they can be solid-soluble in a large amount in zirconium oxide to readily provide cubic zirconium oxide which is excellent in the thermal stability. Further, the above elements may be used in combination as a mixture of two or more of them.

In the present invention, the amount of at least one element selected from Group 2A and Group 3A may be selected with reference to the phase diagram. However, in the case of the above mentioned calcium, the amount is preferably from 4 to 20 mol % as calculated as calcium oxide, particularly preferably from 15 to 20 mol %, since it is thereby possible to obtain a thermally stable cubic zirconium oxide at a low temperature.

In the present invention, zirconium oxide preferably contains a thermally stable phase of cubic zirconium oxide within the operational temperature range (from 1400 to 1800 K) of the thermal field emission cathode. However, the effects of the present invention can be accomplished also in a case where zirconium oxide contains a metastable phase of tetragonal zirconium oxide. Both crystal systems may be co-existent. However, in a case where either one is present alone, especially in a case where the thermally stable cubic zirconium oxide is present alone, the effects of the present invention can be obtained more constantly.

Such cubic zirconium oxide or tetragonal zirconium oxide can readily be obtained by adding at least one element selected from Group 2A and Group 3A. For example, there may be mentioned a method in which at least one element selected from Group 2A and Group 3A, is dispersed in a solvent such as water or an organic solvent, together with a zirconium source such as zirconium oxide or zirconium hydride, to obtain a slurry which is then coated on a needle electrode made of tungsten single crystal, followed by heating in an oxygen atmosphere, or a method wherein at least one element selected from Group 2A and Group 3A is mixed to the zirconium source, followed by heating, to preliminarily obtain cubic or tetragonal zirconium oxide, or zirconium oxide containing them, which is then formed into a powder and coated on a needle electrode.

Among such methods, preferred is a method which comprises coating a slurry comprising a solvent such as water or an organic solvent, and a powder containing zirconium and at least one element selected from Group 2A and Group 3A, followed by heating in an oxidizing atmosphere to form a source for supplying zirconium and oxide on a tungsten single crystal, since it can easily be carried out without substantially changing the conventional process. On the other hand, a thermal field emission cathode obtainable by the method wherein at least one element selected from Group 2A and Group 3A is mixed to the zirconium source, followed by heating, to preliminarily obtain cubic or tetragonal zirconium oxide, or zirconium oxide containing them, which is then formed into a powder and coated on a needle electrode, has a feature that the starting emission is stable, and fluctuation in the electron emission characteristics among thermal field emission cathodes is little.

Further, in the above method, it is preferred to incorporate zirconium oxide and zirconium hydride as zirconium components in the powder, since it is thereby possible to readily accomplish stable electron emission characteristics when a thermal field emission cathode is prepared.

Further, it is preferred to employ zirconium oxide prepared by heating zirconium oxide containing from 4 to 20 mol % of calcium oxide at a temperature of from 1400 to 1800 K, as a zirconium component in the powder, since the powder obtainable by such an operation contains cubic zirconium oxide, whereby the effects of the present invention can be certainly obtainable.

Now, the present invention will be described in further detail with reference to Example and Comparative Examples. However, it should be understood that the present invention is by no means restricted to such specific Examples.

EXAMPLES 1 TO 5

A tungsten wire was fixed by spot welding to metal supports brazed to an insulating glass, and then a W-chip cut from a single crystal tungsten slender wire having an axis direction <100>, was fixed by spot welding to the above mentioned tungsten wire. Further, the end of the W-chip was subjected to electropolishing to form a sharp end, to obtain an intermediate for a thermal field emission cathode.

On the other hand, cubic zirconium oxide powder obtained by heating zirconium oxide containing 12 mol % of calcium oxide at 1800 K for 3 hours, and commercially available zirconium hydride powder were blended so that the molar ratio of zirconium would be 1:1 and, using isoamyl acetate as a dispersing medium, pulverized and mixed in a mortar to obtain a slurry.

The slurry was coated on the W-chip of the above intermediate for a thermal field emission cathode (at a center position between the end of the W-chip and the fixing position to the tungsten wire) to preliminarily form a reservoir. After evaporation of isoamyl acetate in the slurry, the W-chip was heated to 1800 K by conducting a current to the tungsten wire in an ultrahigh vacuum of $1\times10^{-9}$ Torr to thermally decompose zirconium hydride into zirconium and hydrogen and thereby to calcine and solidify the reservoir. Further, the W-chip was heated for 20 hours in an oxygen atmosphere of $3\times10^{-6}$ Torr to oxidize, calcine and diffuse zirconium in the reservoir, to form a ZrO coating layer on the surface of the W-chip.

With respect to each of five thermal field emission cathodes obtained by the above procedure, electric heating and cooling (stopping of current conduction) were repeated 200 times under an ultrahigh vacuum of $1\times10^{-9}$ Torr, whereupon the state of the reservoir was inspected. In each case, no abnormality was observed, and the state of the reservoir was good after repetition of the heating and cooling, as shown in Table 1.

Further, separately from those used for the above evaluation, five thermal field emission cathodes were prepared by the above procedure, and each of them was actually mounted on a scanning electron microscope, and the number of repetition of heating and cooling, and the service life, were examined under the practical operational condition. The results are shown in Table 2.

TABLE 1

| | | Materials for the reservoir | Number of times of repetition of heating and cooling | Results of inspection of the reservoir |
|---|---|---|---|---|
| Ex. | 1 | Zirconium hydride + | 200 | No abnormality |
| | 2 | Zirconium oxide | 200 | No abnormality |
| | 3 | containing 12 mol % | 200 | No abnormality |
| | 4 | of calcium oxide | 200 | No abnormality |
| | 5 | | 200 | No abnormality |
| Com. | 1 | Zirconium hydride | 32 | Fell off |
| Ex. | 2 | alone | 56 | Fell off |
| | 3 | | 12 | Fell off |
| | 4 | | 45 | Fell off |
| | 5 | | 23 | Fell off |

TABLE 2

| | | Materials for the reservoir | Number of times of repetition of heating and cooling | Service life (hrs) |
|---|---|---|---|---|
| Ex. | 1 | Zirconium hydride + | 165 | 6210 |
| | 2 | Zirconium oxide | 230 | 8090 |
| | 3 | containing 12 mol % | 312 | 11010 |
| | 4 | of calcium oxide | 156 | 8420 |
| | 5 | | 282 | 7050 |
| Com. | 1 | Zirconium hydride | 35 | 2010 |
| Ex. | 2 | alone | 51 | 1680 |
| | 3 | | 23 | 5920 |
| | 4 | | 45 | 2850 |
| | 5 | | 32 | 1950 |

COMPARATIVE EXAMPLES 1 TO 5

On the other hand, as Comparative Examples, with respect to five thermal field emission cathodes prepared by same procedure as the above Examples except that a slurry containing zirconium hydride alone, was used, the same evaluation as in the Examples was carried out, whereby a phenomenon was observed such that the reservoir fell off when heating and cooling were repeated from 12 to 56 times. The results are shown in Table 1. Further, in the same manner as in the Examples, with respect to another five thermal field emission cathodes, each of them was actually mounted on a scanning electron microscope, and the number of times of repetition of heating and cooling, and the service life, were evaluated. The results are shown in Table 2.

It is evident from the Examples that as compared with conventional products, the thermal field emission cathodes of the present invention are stable without falling off of the reservoir even when subjected to repetition of heating and cooling, and a long service life is thereby accomplished.

As described in the forgoing, the thermal field emission cathode of the present invention is a highly reliable thermal field emission cathode which is operable under a stabilized condition over a long period of time without falling off of the reservoir by e.g. repetition of heating and cooling and which has a long service life and yet has little fluctuation, and it is effective as an electron source for various electron beam equipments.

Further, according to the method for producing a thermal field emission cathode of the present invention, such a thermal field emission cathode can easily be presented without substantial changes of the conventional process, and it is practically useful.

What is claimed is:

1. A thermal field emission cathode comprising a tungsten single crystal having an axis direction of <100> and a coating layer of zirconium and oxygen formed thereon, wherein a source for supplying zirconium and oxygen contains an element capable of forming cubic or tetragonal zirconium oxide at an operation temperature of the thermal field emission cathode.

2. The thermal field emission cathode according to claim 1, wherein said element is at least one element selected from Group 2A and Group 3A.

3. The thermal field emission cathode according to claim 2, wherein said element is at least one of calcium and yttrium.

4. The thermal field emission cathode according to claim 3, wherein said element is calcium.

5. The thermal field emission cathode according to claim 4, wherein the source for supplying zirconium and oxygen is zirconium oxide containing calcium in an amount of from 4 to 20 mol % as calculated as its oxide.

6. The thermal field emission cathode according to claim 5, wherein the source for supplying zirconium and oxygen is zirconium oxide containing calcium in an amount of from 15 to 20 mol % as calculated as its oxide.

7. A thermal field emission cathode comprising a tungsten single crystal having an axis direction of <100> and a coating layer of zirconium and oxygen formed thereon, wherein a source for supplying zirconium and oxygen contains at least one of cubic zirconium oxide and tetragonal zirconium oxide, and at least one element selected from Group 2A and Group 3A.

8. The thermal field emission cathode according to claim 7, wherein the source for supplying zirconium and oxygen comprises cubic zirconium oxide.

9. The thermal field emission cathode according to claim 8, wherein the cubic zirconium oxide contains at least one of calcium and yttrium.

10. The thermal field emission cathode according to claim 9, wherein the cubic zirconium oxide is zirconium oxide containing calcium in an amount of from 4 to 20 mol % as calculated as its oxide.

11. The thermal field emission cathode according to claim 10, wherein the cubic zirconium oxide is zirconium oxide containing calcium in an amount of from 15 to 20 mol % as calculated as its oxide.

12. A method for producing a thermal field emission cathode comprising a tungsten single crystal having an axis direction of <100> and a coating layer of zirconium and oxygen formed thereon, which comprises coating a slurry comprising a solvent and a powder containing zirconium and at least one element selected from Group 2A and Group 3A, followed by heating in an oxidizing atmosphere to form a source for supplying zirconium and oxygen on said tungsten single crystal.

13. The method for producing a thermal field emission cathode according to claim 12, wherein said powder contains zirconium oxide and zirconium hydride.

14.The method for producing a thermal field emission cathode according to claim 12, wherein said powder contains zirconium oxide obtained by heating zirconium oxide containing from 4 to 20 mol % of calcium oxide at a temperature of from 1400 to 1800 K.

* * * * *